US009854886B1

(12) United States Patent
Xia et al.

(10) Patent No.: US 9,854,886 B1
(45) Date of Patent: Jan. 2, 2018

(54) INFLATABLE INSULATION BOX

(71) Applicant: Zhejiang Natural Travel Goods Co., Ltd., Taizhou, Zhejiang (CN)

(72) Inventors: Yonghui Xia, Taizhou (CN); Jinglong Cao, Taizhou (TW)

(73) Assignee: Zhejiang Natural Travel Goods Co., Ltd. (CN)

( * ) Notice: Subject to any disclaimer, the term of this patent is extended or adjusted under 35 U.S.C. 154(b) by 0 days.

(21) Appl. No.: 15/215,939

(22) Filed: Jul. 21, 2016

(30) Foreign Application Priority Data

Jul. 15, 2016 (CN) ..... 2016 2 0751201 U

(51) Int. Cl.

| | |
|---|---|
| ***B65D 81/18*** | (2006.01) |
| ***B65D 81/38*** | (2006.01) |
| ***A45C 7/00*** | (2006.01) |
| ***A45C 3/00*** | (2006.01) |
| ***A45C 11/20*** | (2006.01) |
| ***A45C 13/10*** | (2006.01) |
| ***A45C 11/22*** | (2006.01) |
| ***A45C 13/26*** | (2006.01) |
| ***A61J 1/16*** | (2006.01) |

(52) U.S. Cl.
CPC ..... *A45C 7/0081* (2013.01); *A45C 3/001* (2013.01); *A45C 11/20* (2013.01); *A45C 11/22* (2013.01); *A45C 13/103* (2013.01); *A45C 13/26* (2013.01); *A61J 1/165* (2013.01); *B65D 81/3888* (2013.01)

(58) Field of Classification Search
CPC ..... A45C 7/008; A45C 3/001; A45C 11/20; A45C 13/103; A45C 13/26; A61J 1/165; B65D 81/3888
USPC ..... 220/592.2, 592.03, 592.11, 592.21, 220/592.28
See application file for complete search history.

(56) References Cited

U.S. PATENT DOCUMENTS

| | | | | |
|---|---|---|---|---|
| 4,044,867 A * | 8/1977 | Fisher | A45C 7/004 | 190/107 |
| 4,085,785 A * | 4/1978 | Hoot | B65D 81/3881 | 206/522 |
| 4,612,781 A * | 9/1986 | Swerdon | B65D 81/3881 | 383/110 |
| 4,809,352 A * | 2/1989 | Walker | A45C 3/00 | 206/522 |
| D333,592 S * | 3/1993 | Walker | D7/605 | |
| 6,070,422 A * | 6/2000 | Alvenes | B60P 7/04 | 165/46 |

(Continued)

*Primary Examiner* — J. Gregory Pickett
*Assistant Examiner* — Niki M Eloshway
(74) *Attorney, Agent, or Firm* — Harness, Dickey & Pierce, P.L.C.

(57) ABSTRACT

Provided is an inflatable insulation box relating to the technical field of cold insulation equipment for cold chain transportation, comprising a box body and a box lid, wherein the box body has an opening and the box lid is configured to close the opening of the box body; the box body and the box lid include fabrics on outer layers and airbags on inner layers, respectively; an air valve is provided on the box body and/or the box lid to inflate or deflate the airbags; reflective fabrics may also be used on inner surfaces of the box body and the box lid to improve thermal insulation performance. This inflatable insulation box has good thermal insulation effect, and can be conveniently inflated and deflated and conveniently folded up, reducing occupied space.

20 Claims, 4 Drawing Sheets

(56) References Cited

U.S. PATENT DOCUMENTS

| | | | | |
|---|---|---|---|---|
| 6,123,217 | A * | 9/2000 | Miller | B65D 81/3881 206/522 |
| D506,645 | S * | 6/2005 | Bellofatto, Jr. | D7/607 |
| 9,284,094 | B2 * | 3/2016 | Khalil | B65D 21/086 |
| 2003/0024937 | A1 * | 2/2003 | Hart | A47J 41/0066 220/592.2 |
| 2007/0023439 | A1 * | 2/2007 | Vaughn | F25D 3/08 220/592.03 |
| 2008/0011759 | A1 * | 1/2008 | Hsu | B65D 81/383 220/592.2 |
| 2008/0164265 | A1 * | 7/2008 | Conforti | B65D 81/3823 220/592.2 |
| 2010/0252560 | A1 * | 10/2010 | Churchill | A47G 23/02 220/560 |
| 2013/0119850 | A1 * | 5/2013 | Breyburg | A47B 71/00 312/408 |
| 2015/0008242 | A1 * | 1/2015 | Kpabar, Jr. | B67D 3/0061 222/183 |
| 2015/0225164 | A1 * | 8/2015 | Seiders | B65D 81/3858 220/592.25 |

* cited by examiner

INFLATABLE INSULATION BOX

TECHNICAL FIELD

The present invention relates to the technical field of cold insulation equipment for cold chain transportation, and particularly to an inflatable insulation box.

BACKGROUND ART

In the industries of outdoor sports and logistics, there is usually a requirement to store and transport temperature-sensitive products or articles, such as pharmaceutical vaccine articles, fresh foods, fruits, cold drinks, foodstuff and the like, which should be maintained within an appropriate temperature range during transportation so as to ensure the quality of the transported articles. It needs more than ever to keep temperature and freshness of products as the rise of food E-commerce.

Now, EPP (Expanded polyproplene) boxes are commonly applied to current insulation boxes, i.e. insulation boxes made from polypropene plastic foam materials. However, the EPP boxes have disadvantages as shown below:

1. It takes much efforts to separate a lid from the EPP box as it is not easy to open the lid;
2. Cold insulation performance is poor, and space utilization is inefficient due to a heavy ice plate which occupies a relatively large space in the box, generally, under the requirements of cold insulation, an 8 kg-ice plate is required to be placed onto a 25 L incubator to meet the needs;
3. The body of the EPP box is relatively thick and cannot be folded, occupying too much space.

In the current market, there are also insulation boxes with a box body filled with a foam layer, which can be compressed and folded if empty to decrease the space occupied. However, such box body has barely satisfactory thermal insulation performance, and has no obvious effects on space saving.

DISCLOSURE OF THE INVENTION

An object of the present invention is to provide an inflatable insulation box to solve technical problems of large volume and inconvenient storing and carrying of insulation boxes in the prior art.

The inflatable insulation box provided in the present invention comprises a box body and a box lid;

wherein the box body is integrally connected with the box lid; and the box body has an opening, and the box lid is configured to close the opening of the box body;

the box body and the box lid include fabrics on outer layers and airbags on inner layers, respectively;

an air valve is provided on the box body and/or the box lid and is configured to inflate or deflate the airbags.

Airbags used for thermal insulation result in a better performance. When stored, the air valve can be opened, and the box body and the box lid are squeezed to deflate the airbags, and folded up after compressed so as to minimize the volume for storage.

In a preferable embodiment of the present invention, inner surfaces of the outer layers on both the box body and the box lid are of reflective fabrics.

In a preferable embodiment of the present invention, metallic silver is coated on surfaces of the reflective fabrics.

The utilization of the reflective fabrics can well improve the thermal insulation performance of the box body.

In a preferable embodiment of the present invention, the airbags of the box body communicate with the airbags of the cover lid.

By using communicating airbags, inflating and deflating of the whole incubator can be realized only by providing one air valve on the box body or the cover lid, enabling a simpler structure.

In a preferable embodiment of the present invention, the airbags are bar-like airbags closely arranged in parallel.

The airbags employ mini bar-like airbags which are independent but communicate may effectively decrease the thickness after the airbags are inflated, providing a larger space inside the box body and meanwhile effectively preventing airbag damages.

In a preferable embodiment of the present invention, the box lid is connected with the opening of the box body by means of a waterproof zipper.

The box lid is connected with the box body by means of a waterproof zipper, which facilitates the opening and closing of the insulation box and results in a good sealing effect and ease of use at the same time.

In a preferable embodiment of the present invention, the inflatable insulation box also includes a sealing and thermal insulating strip, and the sealing and thermal insulating strip is circumferentially disposed along inner edges of the box lid and capable of covering over the waterproof zipper.

Based on the connection of the box lid and the box body by the waterproof zipper, configuration of the sealing and thermal insulating strip ensures the sealing and thermal insulation effects at the waterproof zipper, improves the thermal insulation performance of the product and further insures that the product is capable of maintaining its internal temperature for a long time.

In a preferable embodiment of the present invention, handles are provided respectively on two opposing outer sidewalls of the box body, respectively, or a strap is provided on two opposing outer sidewalls of the box body.

In a preferable embodiment of the present invention, the handles are made of webbing, two ends of which are connected with the outer sidewalls of the box body respectively to allow the handles to have an n-shaped structure.

The handles are made of webbing, which reduces the overall weight of the product due to the lighter weight of the webbing. The webbing forms handles having an n-shaped structure, which facilitates the use of the handles. It should be indicated that the webbing may use PP (Polypropylene) webbing, namely, polypropylene webbing, or braided webbing, further or nylon and cotton webbing, etc.

In a preferable embodiment of the present invention, outer wall surfaces or inner wall surfaces of the box body are provided with mesh bags.

The mesh bags on the outer wall surfaces may be used for storing objects at room temperature, and the mesh bags on the inner wall surfaces may be configured to fix the articles inside the box body or store ice bags.

In a preferable embodiment of the present invention, the mesh bags are nylon mesh bags.

The nylon mesh bag has a simple structure and a light weight, making installation operation simple, reducing the overall weight of the product and facilitating product transportation.

In a preferable embodiment of the present invention, the box body includes a front side face, a rear side face, a left side face, a right side face and a bottom face which are integrally connected, and the box lid is integrally connected with the rear side face of the box body; and creases are provided between the individual faces of the box body and between the box lid and the box body.

The present invention has advantages that:

The inflatable insulation box has good thermal insulation effect, and can be conveniently inflated and deflated and conveniently folded up, reducing occupied space.

BRIEF DESCRIPTION OF DRAWINGS

In order to illustrate technical solutions of specific embodiments in the present invention and of the prior art more clearly, drawings which are needed for description of the specific embodiments or the prior art will be briefly introduced hereinafter. Apparently, drawings below merely show some embodiments of the present invention, and other drawings can also be obtained, in light of these drawings, by those skilled in the art without making any creative efforts.

Figure 1:
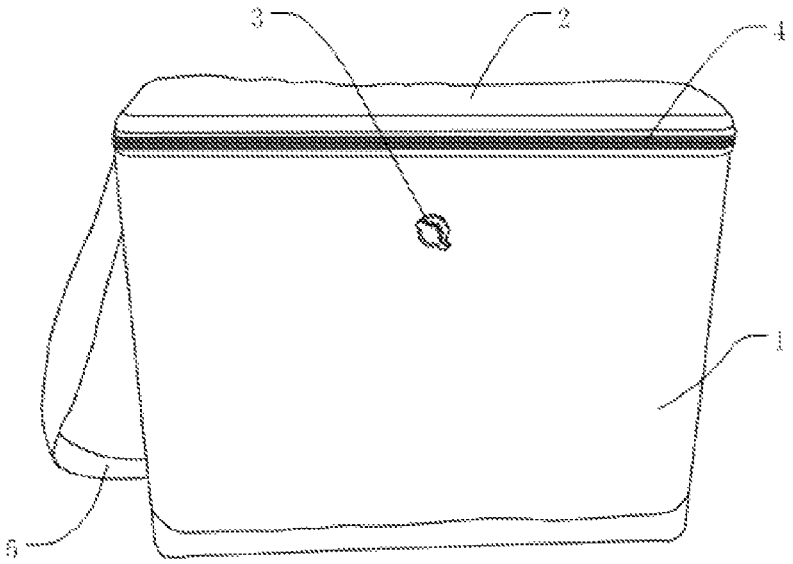
FIG. 1 is a front schematic view of an inflatable insulation box provided by an example of the present invention when closed.

Reference signs are summarized as follows:

1—box body; 101—front side face of the box body;
102—bottom face of the box body; 103—left side face of the box body;
104—right side face of the box body; 105—rear side face of the box body;
2—box lid; 3—air valve;
4—waterproof zipper; 5—strap;
6—airbag; 7—crease.

DETAILED DESCRIPTION OF EMBODIMENTS

The technical solutions of the present invention will be described clearly and completely hereinafter, in conjunction with drawings. Apparently, some but not all of examples of the present invention are described. All of the other examples, obtained by those skilled in the art based on the examples of the present invention without making any creative efforts, fall within the scope of protection of the present invention.

In the description of the present invention, it should be noted that orientational or positional relationships indicated by terms, such as "center", "upper", "lower", "left", "right", "vertical", "horizontal", "inner", and "outer", are based on the orientational or positional relationships shown in the drawings, merely for facilitating the description of the present invention and simplifying the description, rather than indicating or implying that the related devices or elements have to be in the specific orientation or configured and operated in the specific orientation, therefore they shall not be construed as limiting the present invention. Furthermore, terms, such as "first", "second" and "third", are only used for illustrative purposes, and shall not be construed as indicating or implying to have importance in relativity.

In the description of the present invention, it should be noted that, unless otherwise expressly specified and defined, terms, such as "install", "connect" and "connection", should be broadly interpreted. For example, it may be a fixed connection, a detachable connection, or an integral connection; or it may be a mechanical connection or an electrical connection; or it may be a direct connection or an indirect connection through an intermediate medium, or it may be an inner connection between two elements. For those skilled in the art, specific meanings of the above-mentioned terms in the present invention can be understood based on specific situations.

The present invention provides an inflatable insulation box, comprising a box body and a box lid;

the box body has an opening; and the box lid is configured to close the opening of the box body;

the box body and the box lid include fabrics on outer layers and airbags on inner layers, respectively; and an air valve is provided on the box body and/or the box lid and is configured to inflate or deflate the airbags.

Further, inner surfaces of the outer layers on both the box body and the box lid are of reflective fabrics.

Further, metallic silver is coated on surfaces of the reflective fabrics.

Further, the airbags of the box body communicate with the airbags of the box lid.

Further, the airbags are bar-like airbags closely arranged in parallel.

Further, the box lid is connected with the opening of the box body by means of a waterproof zipper.

Further, the inflatable insulation box also includes a sealing and thermal insulating strip; and the sealing and thermal insulating strip is circumferentially disposed along inner edges of the box lid, and capable of covering over the waterproof zipper.

Further, handles are provided on two opposing outer sidewalls of the box body, respectively, or a strap is provided on two opposing outer sidewalls of the box body.

Further, outer wall surfaces or inner wall surfaces of the box body are provided with mesh bags.

Further, the box body includes a front side face, a rear side face, a left side face, a right side face and a bottom face which are integrally connected, and the box lid is integrally connected with the rear side face of the box body; and creases are provided between the individual faces of the box body and between the box lid and the box body.

Figure 2:
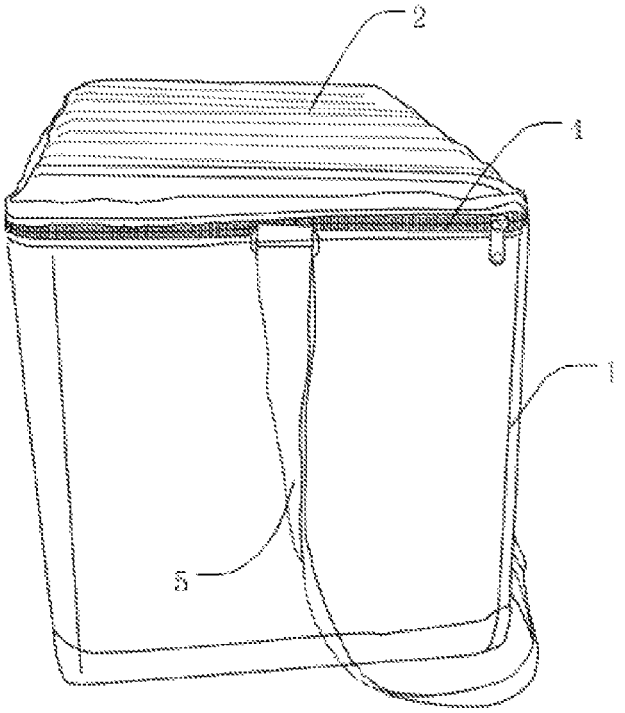
FIG. 2 is a side schematic view of the inflatable insulation box shown in FIG. 1 when closed.
Figure 3:
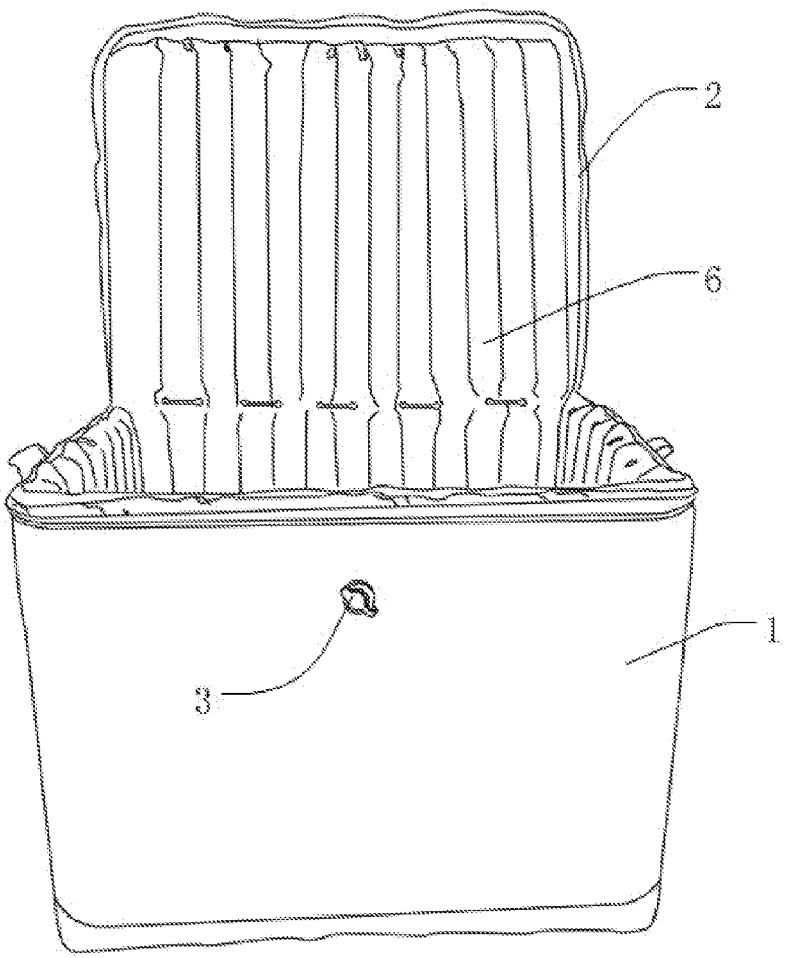
FIG. 3 is a front schematic view of the inflatable insulation box shown in FIG. 1 when a box lid is opened.
Figure 4:
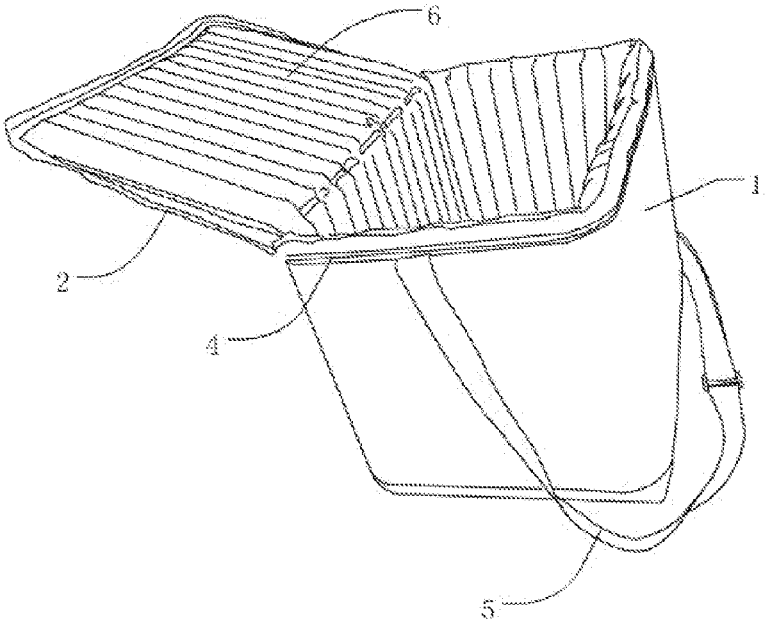
FIG. 4 is a side schematic view of the inflatable insulation box shown in FIG. 1 when a box lid is opened.
Figure 5:
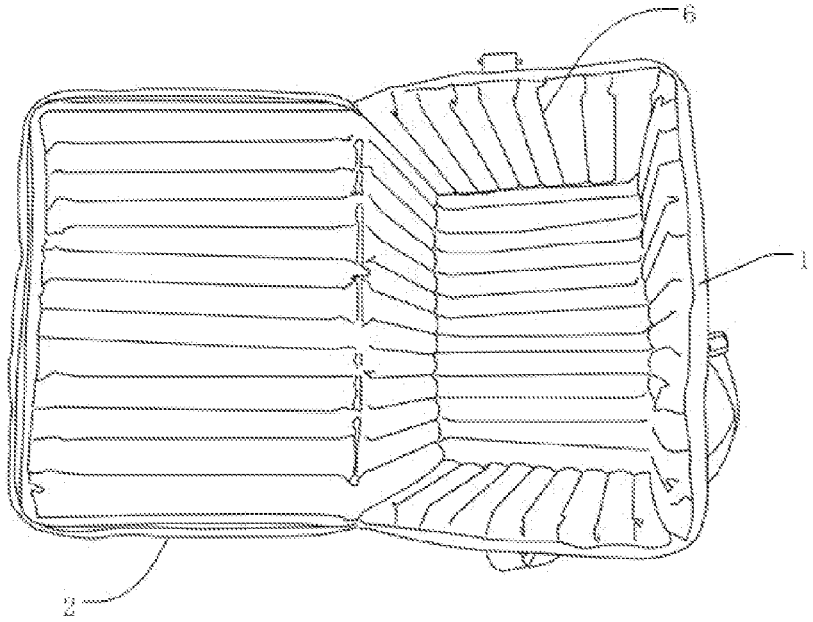
FIG. 5 is a top view of the inflatable insulation box shown in FIG. 1 when a box lid is opened.
Figure 6:
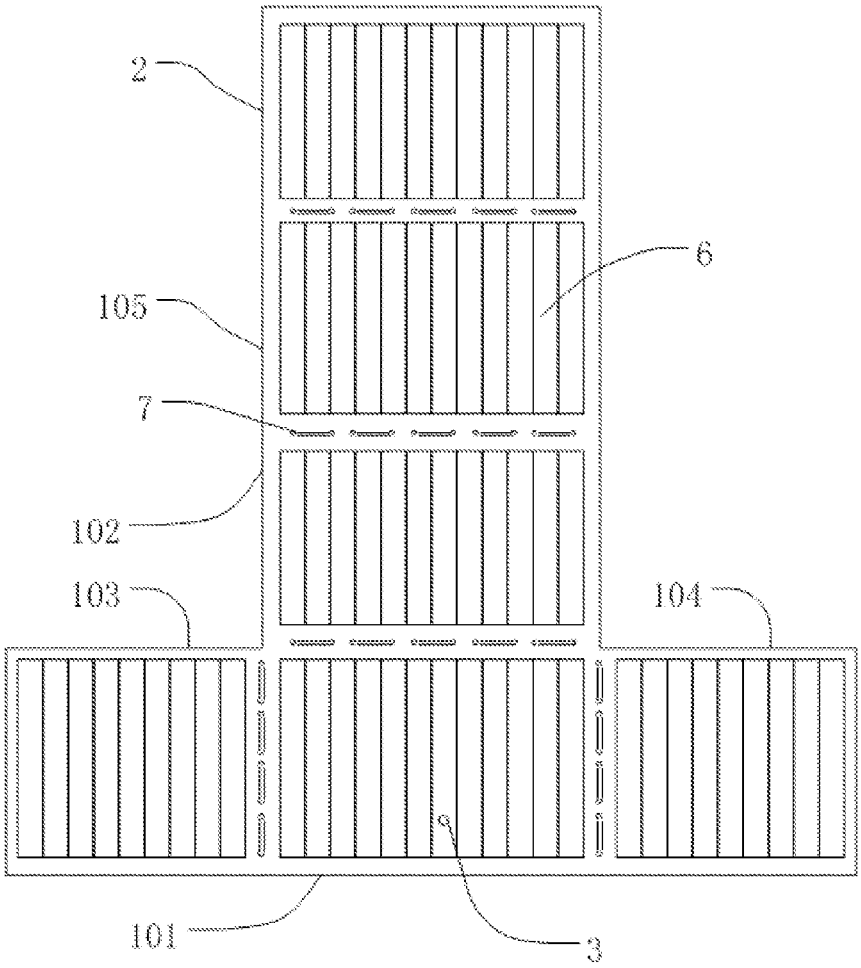
FIG. 6 is a structural schematic view of the inflatable insulation box shown in FIG. 1 when completely unfolded.

FIG. 1 is a front schematic view of an inflatable insulation box provided by an example of the present invention when closed; FIG. 2 is a side schematic view of the inflatable insulation box shown in FIG. 1 when closed; FIG. 3 is a front schematic view of the inflatable insulation box shown in FIG. 1 when a box lid is opened; FIG. 4 is a side schematic view of the inflatable insulation box shown in FIG. 1 when a box lid is opened; FIG. 5 is a top view of the inflatable insulation box shown in FIG. 1 when a box lid is opened; and FIG. 6 is a structural schematic view of the inflatable insulation box shown in FIG. 1 when completely unfolded.

As depicted in FIG. 1-6, the inflatable insulation box provided by the example comprises a box body 1 and a box lid 2.

The box body 1 is integrally connected with the box lid 2. Specifically, the box body 1 comprises a front side face 101 of the box body, a bottom face of the box body, a left side face 103 of the box body, a right side face 104 of the box body and a rear side face 105 of the box body that are integrally connected, and the box lid 2 is integrally connected with the rear side face 105 of the box body. This generates the unfolded view as depicted in FIG. 6. The inflatable insulation box described in the example can be obtained by folding the individual faces of the box body and the box lid, in which the box body 1 has an opening and the box lid 2 is configured to close the opening of the box body 1.

The individual faces of the box body 1 and the box lid 2 comprise fabrics on the outer layers and airbags 6 on the inner layers, respectively, and the airbags on the individual faces of the box body 1 communicate with the airbags of the box lid 2 to form an integer. An air valve 3 is provided on the front side face 101 of the box body 1 and configured to inflate or deflate all of the airbags 6 of the box body 1 and the box lid 2.

In other solutions of the example, the airbags of the individual faces of the box body 1 may not communicate or selectively-partially communicate with the airbags of the box lid 2, and the air valve 3 is provided on the box body 1 or the box lid 2 and configured to communicate with the airbags of the individual parts.

Airbags used for thermal insulation result in a better performance. When stored, the air valve can be opened, and the box body and the box lid are squeezed to deflate the airbags, and folded up after compressed so as to minimize the volume for storage.

The inner surfaces on the outer layers of the box body 1 and the box lid 2 are configured as reflective fabrics so as to allow the inflatable insulation box to have a better thermal insulation effect. For example, the common fabrics may have surfaces coated with metallic silver to make them become reflective fabrics.

The utilization of reflective fabrics can well improve the thermal insulation performance of the box body.

The outer fabrics of the box body 1 and the box lid 2 may be PVC sandwich weaved materials, i.e. polyvinyl chloride materials. On the one hand, as the outer fabric, PVC sandwich weaved materials reduces the weight of the product due to their lighter weight, which facilitates product transportation, on the other hand, PVC sandwich weaved materials facilitate folding of the product, and allow the product to be easily cleaned.

In a preferable technical solution of the example, airbags on the individual faces of the box body 1 and the box lid 2 are all bar-like airbags closely arranged in parallel. The airbags on the individual faces of the box body 1 and the box lid 2 have a thickness not greater than 15 mm after being inflated.

The airbags employ mini bar-like airbags which are independent but communicate may effectively decrease the thickness after the airbags are inflated, providing a larger space inside the box body, and meanwhile effectively preventing airbag damages.

In the example, the opening of the box body 1 is connected with the box lid 2 by means of a waterproof zipper 4. At the same time, with the purpose of achieving better thermal insulation performance, a sealing and thermal insulating strip is circumferentially disposed along inner edges of the box lid 2, and capable of covering over the waterproof zipper 4.

Connecting the box lid with the box body by means of the waterproof zipper facilitates the opening and closing of the insulation box and results in a good sealing effect and ease of use at the same time. The configuration of the sealing and thermal insulating strip ensures the sealing and thermal insulation effects at the waterproof zipper, improves the thermal insulation performance of the product and further insures that the product is capable of maintaining its internal temperature for a long time.

In the examples, a strap 5 is provided on the left side face 103 and the left side face 104 of the box body 1.

In other solutions of the example, handles may be provided on the left side face 103 and the right side face 104 of the box body 1 respectively. The handles may be made of webbing and have an n-shaped structure.

In an preferable solution of the example, outer wall surfaces or inner wall surfaces of the box body 1 are provided with mesh bags. The mesh bags on the outer wall surfaces may be used for storing goods at room temperature, and the mesh bags on the inner wall surfaces may be configured to fix the articles inside the box body or store ice bags.

In an preferable solution of the example, creases 7 are provided among the front side face 101 of the box body, the bottom face 102 of the box body, the left side face 103 of the box body, the right side face 104 of the box body, the rear side face of the box body and the box lid respectively, so as to enable more convenient folding and compressing.

Finally, it should be indicated that, all of the above-mentioned examples are only used for illustration of the technical solutions of the present invention, and not for limiting it. Although the present invention have been detailed with reference to the foregoing examples, those skilled in the art shall understand that they can still make modifications to the technical solutions as illustrated by the foregoing examples or equivalent substitutions to a part or all of the technical features. Such modifications or substitutions shall not cause the essence of the corresponding technical solutions to depart from the scope of the technical solutions as illustrated by the examples of the present invention.

The invention claimed is:

1. An inflatable insulation box, comprising a box body and a box lid;

wherein the box body has an opening, and the box lid is configured to close the opening of the box body;

the box body and the box lid comprise fabrics on outer layers and airbags on inner layers, respectively; and an air valve is provided on the box body and/or the box lid and is configured to inflate or deflate the airbags, wherein the box body comprises a front side face, a rear side face, a left side face, a right side face, a bottom face and the box lid which are integrally connected to one another;

each of the front side face, rear side face, left side face, right side face, bottom face and box lid has a rectangular shape in a plan view;

in an unfolded state:

the left side face, the front side face and the right side face are sequentially aligned in a row and the air bags respectively provided on the left side face, the front face and the right side face all extend parallel to one another, and the front side face, the bottom side face, the rear side face, and the box lid are sequentially aligned in a column and the air bags respectively provided on the front side face, the bottom side face, the rear side face and the box lid all extend in alignment with one another, the front side face, the rear side face, the left side face, the right side face, the bottom face and the box lid are configured to form the insulation box after folded; and connection portions interconnecting adjacent ones of the front side face, rear side face, left side face, right side face, bottom face and box lid extend along an entire width or length of the rectangular shapes.

2. The inflatable insulation box according to claim 1, wherein inner surfaces of the outer layers of the box body and the box lid are of reflective fabrics.

3. The inflatable insulation box according to claim 2, wherein metallic silver is coated on surfaces of the reflective fabrics.

4. The inflatable insulation box according to claim 3, wherein handles are provided respectively on two opposing outer sidewalls of the box body, or a strap is provided on two opposing outer sidewalls of the box body.

5. The inflatable insulation box according to claim 2, wherein that the box lid is connected with the opening of the box body by means of a waterproof zipper.

6. The inflatable insulation box according to claim 5, further comprising a sealing and thermal insulating strip; the sealing and thermal insulating strip is circumferentially disposed along inside edges of the box lid and capable of covering over the waterproof zipper.

7. The inflatable insulation box according to claim 2, wherein handles are provided respectively on two opposing outer sidewalls of the box body, or a strap is provided on two opposing outer sidewalls of the box body.

8. The inflatable insulation box according to claim 2, wherein mesh bags are provided on outer wall surfaces or inner wall surfaces of the box body.

9. The inflatable insulation box according to claim 1, wherein the airbags of the box body communicate with the airbags of the box lid.

10. The inflatable insulation box according to claim 9, wherein the box lid is connected with the opening of the box body by means of a waterproof zipper.

11. The inflatable insulation box according to claim 10, further comprising a sealing and thermal insulating strip; and the sealing and thermal insulating strip is circumferentially disposed along inner edges of the box lid and capable of covering over the waterproof zipper.

12. The inflatable insulation box according to claim 9, wherein handles are provided respectively on two opposing outer sidewalls of the box body, or a strap is provided on two opposing outer sidewalls of the box body.

13. The inflatable insulation box according to claim 1, wherein the airbags are bar-like airbags that are closely arranged in parallel.

14. The inflatable insulation box according to claim 13, wherein the box lid is connected with the opening of the box body by means of a waterproof zipper.

15. The inflatable insulation box according to claim 14, further comprising a sealing and thermal insulating strip; and the sealing and thermal insulating strip is circumferentially disposed along inner edges of the box lid and capable of covering over the waterproof zipper.

16. The inflatable insulation box according to claim 1, wherein the box lid is connected with the opening of the box body by a waterproof zipper.

17. The inflatable insulation box according to claim 16, further comprising a sealing and thermal insulating strip; and the sealing and thermal insulating strip is circumferentially disposed along inner edges of the box lid and capable of covering over the waterproof zipper.

18. The inflatable insulation box according to claim 1, wherein handles are provided respectively on two opposing outer sidewalls of the box body, or a strap is provided on two opposing outer sidewalls of the box body.

19. The inflatable insulation box according to claim 1, wherein mesh bags are provided on outer wall surfaces or inner wall surfaces of the box body.

20. The inflatable insulation box according to claim 1, wherein creases are provided between individual faces of the box body and between the box lid and the box body.

* * * * *